US009549608B1

(12) United States Patent
Emery

(10) Patent No.: US 9,549,608 B1
(45) Date of Patent: Jan. 24, 2017

(54) PAINT EDGER DEVICES

(71) Applicant: Leith Seanan Emery, Palos Verdes Estates, CA (US)

(72) Inventor: Leith Seanan Emery, Palos Verdes Estates, CA (US)

( * ) Notice: Subject to any disclaimer, the term of this patent is extended or adjusted under 35 U.S.C. 154(b) by 0 days.

(21) Appl. No.: 15/052,420

(22) Filed: Feb. 24, 2016

Related U.S. Application Data

(62) Division of application No. 13/828,528, filed on Mar. 14, 2013, now Pat. No. 9,272,304.

(60) Provisional application No. 61/689,663, filed on Jun. 11, 2012, provisional application No. 61/689,665, filed on Jun. 11, 2012.

(51) Int. Cl.
*A46B 17/08* (2006.01)
*B44D 3/22* (2006.01)

(52) U.S. Cl.
CPC ..... *A46B 17/08* (2013.01); *B44D 3/225* (2013.01); *A46B 2200/202* (2013.01)

(58) Field of Classification Search
CPC ..... B44D 3/00; B44D 3/22; B44D 3/225; B05C 17/00; B05C 17/10; B05C 17/12; B05C 21/00; B05C 21/005; A46B 15/00; A46B 15/055; A46B 17/00; A46B 17/08; A46B 2200/202; A46B 2200/205
USPC ..... 15/166, 246, 248.1
See application file for complete search history.

(56) References Cited

U.S. PATENT DOCUMENTS 1,927,962 A * 9/1933 Tamplin ..... A46B 17/08 15/166
2,078,193 A * 4/1937 Campbell ..... A46B 17/08 15/166
2,175,587 A * 10/1939 Archer ..... B44D 3/225 15/166
2,476,509 A * 7/1949 Reincke ..... B44D 3/225 118/504
2,584,504 A * 2/1952 Seeber ..... B05C 21/005 15/166
2,712,667 A * 7/1955 Stearn ..... B44D 3/225 15/246
2,820,237 A * 1/1958 Maslaney ..... A46B 17/08 15/248.1
2,821,734 A * 2/1958 Carrabine ..... B44D 3/225 15/248.1

(Continued)

FOREIGN PATENT DOCUMENTS

FR 2713062 * 6/1995

*Primary Examiner* — Mark Spisich
(74) *Attorney, Agent, or Firm* — Steven M. Hoffberg, Esq.; Ostrolenk Faber LLP

(57) ABSTRACT

An edger for a paint roller, comprising: a roller frame; a roller cover, having lateral edges, the lateral edges being outside a painting width of the paint roller and being configured to glide against a surface without marring the surface; a displaceable mount, configured to have a first position in which a roller cover is fully engaged over the paint roller and a second position in which the roller cover is disengaged from the paint roller; and at least one auxiliary brush, located on at least one lateral edge of the roller cover, configured to provide painting coverage adjacent to an edge of the roller. A paintbrush edger comprising a linked pair of selectively deployed shields, separated by a wicking space, having tips which glide in a corner, protecting a from contact with paint, while withdrawing paint which seeps into the corner into the wicking space.

20 Claims, 8 Drawing Sheets

(56) References Cited

U.S. PATENT DOCUMENTS

| | | | | | |
|---|---|---|---|---|---|
| 2,900,657 | A | * | 8/1959 | Gruden, Jr. | A46B 17/08 15/248.1 |
| 2,952,863 | A | * | 9/1960 | Klecki | A46B 17/08 15/248.1 |
| 3,075,225 | A | * | 1/1963 | Cohen | A46B 17/08 15/248.1 |
| 3,210,791 | A | * | 10/1965 | Rogholt | A46B 15/00 15/175 |
| 3,337,894 | A | * | 8/1967 | Compton, Jr. | A46B 17/08 15/166 |
| 3,341,879 | A | * | 9/1967 | Kumpman | A46B 17/08 15/166 |
| 3,401,418 | A | * | 9/1968 | Deck | A46B 15/00 15/166 |
| 3,698,033 | A | * | 10/1972 | French | A46B 17/08 15/246 |
| 3,930,278 | A | * | 1/1976 | Nasca | B44D 3/225 15/166 |
| 4,004,318 | A | * | 1/1977 | Balkus, Jr. | A46B 17/08 15/248.1 |
| 4,705,418 | A | * | 11/1987 | van Wesenbeeck | A46B 17/08 15/166 |
| 6,163,920 | A | * | 12/2000 | Meyer | A46B 17/08 15/246 |

* cited by examiner

PAINT EDGER DEVICES

CROSS REFERENCE TO RELATED APPLICATIONS

The present application is a Division of U.S. patent application Ser. No. 13/828,528, filed Mar. 14, 2013, now U.S. Pat. No. 9,272,304, issued Mar. 1, 2016, which claims benefit of priority from U.S. Provisional Patent Application No. 61/689,665, filed Jun. 11, 2012, and from U.S. Provisional Patent Application No. 61/689,663, filed Jun. 11, 2012, each of which is expressly incorporated herein by reference in its entirety.

BACKGROUND OF THE INVENTION

Field of the Invention

This invention relates to painting tools and equipment, and more particularly, it relates to an edger attachment for paintbrushes and paint rollers.

Prior Art

When painting structures, a flat expanse of the surfaces may be painted using a paint roller. In trim areas, a paintbrush may be used. Whether or not a roller is used on the major parts of the wall surface, it is almost always desirable to carry out the edging process as precisely and quickly as possible in order to impart a high quality appearance to the finished room, wall panel or the like. If the hard or trim edge portion to be painted is at the junction of adjacent walls, or a wall and a ceiling, a wavy or meandering edge will create a low quality appearance. Likewise, high contrast and clean appearance is desired for detail and trim areas. If the area to be painted includes an edge or margin bounded by wood or other trim, a poorly applied edge will result in spattering or coating the trim with paint, or leaving unsightly gaps between the trim and paint. Various specialty apparatuses are available for painting and controlling the application of paint to edges, corners, or like margins of painted surfaces are known.

FIG. 1, from U.S. Pat. No. 7,028,365, expressly incorporated herein by reference, shows a paint roller support 10 and a conventional paint roller cover 8 shown removed from the roller support 10. The roller support 10 includes a frame 12 and a handle 60 coupled to a lower end portion 14 of the frame 12. The frame 12 also includes a shaft, or rod, 18 having an inboard end portion 20 and an outboard end portion 22. The shaft 18 is typically made from aluminum or steel. The handle 60 may be configured to be connectable to an extension rod (not shown). An inboard cover support assembly 24 is mounted for rotational movement on the inboard end portion 20 of the shaft 18. An outboard cover support assembly 26 is mounted for rotational movement to the outboard end portion 22 of the shaft 18. In use, the cover support assemblies 24, 26, having locking spring 16, support the cover 8 and allow the cover 8 to be rolled along a surface (e.g., a wall) for applying paint or other surface coating to the surface.

The following references relate to devices for applying liquid coatings to corners or edges, each of which is expressly incorporated herein by reference in its entirety: US Pub. App. Nos. 20130022386 (Paint Trimmer With Edging Guide); 20090151627 (Paint Edger And Trimmer); 20070143946 (Multi Paint Roller Connector); 20050118345 (Paint Edger); 20050115012 (Slideable Nonrolling Spreader); 20040211016 (Painting Apparatus); 20040107525 (Paint Edger With Horizontal And Vertical Guide Wheels); 20030148036 (Paint Rolling System); 20010045014 (Paint Applicator And Method Of Manufacture Thereof); and U.S. Pat. No. 8,025,022 (Painting Device); U.S. Pat. No. 7,622,003 (Paint Edger Having Improved Barrier Edge); U.S. Pat. No. 7,340,796 (Painting Apparatus); U.S. Pat. No. 7,306,389 (Paint Cartridge Edger And Spreader); U.S. Pat. No. 6,877,925 (Paint Rolling System); U.S. Pat. No. 6,865,769 (Paint Edger With Improved Pad And Precision Positioning Adjustment); D482,202 (Paint Edger With Horizontal And Vertical Guide Wheels); U.S. Pat. No. 6,523,219 (Window Scraper Guide; U.S. Pat. No. 6,305,043 (Paint Applicator Having Extension-Receiving Adapter Normally Within Pivotal Handle); U.S. Pat. No. 6,076,225 (Paint Edger With Improved Pad And Precision Positioning Adjustment); U.S. Pat. No. 5,769,769 (Positionable Power Paint Roller With Edger Device); U.S. Pat. No. 5,678,277 (Paint Edger With Improved Pad And Precision Positioning Adjustment); U.S. Pat. No. 5,331,710 (Edger); U.S. Pat. No. 5,134,745 (Paint Trimming Devices); U.S. Pat. No. 4,852,203 (Paint Edger For The Application Of Paint); U.S. Pat. No. 4,339,837 (Paint Brush Accessory); U.S. Pat. Nos. 2,160,570; 2,807,041; 2,835,915; 3,029,458; 3,058,145; 3,538,532; 4,011,622; 4,254,529; 4,569,099; 4,821,362; 5,400,459; 5,960,511; and 6,739,017.

SUMMARY OF THE INVENTION

An edger attachment for a paint roller or paintbrush assists in applying paint to edges around ceilings, doors, windows, and any type of trim.

The edger attachment is useful in trimming or edging along the margin of a surface to be painted, so as to prevent the overlapping of the paint upon adjacent surfaces. The edger attachment is particularly useful for edges around ceilings, doors, windows, and any type of trim.

A preferred embodiment of the edger for a paint roller has a plastic cover consisting of four small paintbrushes on the under-carriage of the cover (on each corner), which can be locked into the closed position to hold the cover over the roller, and also maintained in the open position, to permit loading the roller with paint in a roller pan. This preferred embodiment of the cover serves as an attachment for a standard paint roller, or may be manufactured already attached to a paint roller. The outside of the cover may be in contact with the adjacent wall and serves as a natural guide, guiding the roller in a smooth, straight line along the surface edge which is to be painted, and preventing paint from reaching the adjacent surface not intended to be painted. Four small paint brushes are attached to the under-carriage of the cover to assist the painter in applying paint to the wall with the roller to the intended edge, creating a straight, accurate line, guided by the small brushes against a right-angle adjacent surface. The paint roller cover and small paint brushes are designed and configured so all facets of edging and trimming can be easily, quickly and accurately accomplished, without the use of tape.

A preferred embodiment of the edger for a paintbrush is provided having a planar shield consisting of two edges and a reservoir in between the two edges. The planar shield may be provided as an attachment to a standard paintbrush, or may be manufactured already attached to any paintbrush. The very thin edge of the shield serves as a natural guide, guiding the brush in a smooth, straight line along the surface edge which is to be painted, and preventing paint from reaching the adjacent surface not intended to be painted. The shield and two-edge system are designed and configured so all facets of edging and trimming can be easily, quickly and accurately accomplished, without the use of tape.

The paint brush accessory mountable on a paint brush may include a planar shield having a first edge and an opposed second edge. The first edge is used as a sliding guide upon the intended surface to be guided in a straight line when inserted to said trim or edge at a 45 degree angle. The first edge is very thin at the point of contact with the wall or said surface, and is rounded at each end of the shield. The first edge is intended to block any paint from reaching the adjacent wall. If paint travels around the first edge, the second edge is intended to block said paint from reaching the adjacent wall, in which no paint is intended to reach. There is a hollow space (reservoir) in between the two edges intended to redirect any paint which travels over the first edge and approaching the second edge. This hollow space is an area that covers the entire bottom half of the shield. The first and second edge also have an applied coating of a slippery and smooth material in order to create a smooth ride over the intended surface. The shield is able to open while applying paint to the bristles, and close while applying paint to the edge on the wall or trim.

It is an object to provide an edger for a brush, comprising: at least two adjacent shields, separated by a wicking space, having distal tips configured to glide in a corner, to protect one wall of the corner from contact with brush bristles, and to withdraw paint which seeps into the corner into the wicking space; and a displaceable mount, configured to have a first position in which one of the at least two adjacent shields is adjacent the brush bristles, having the distal tips near tips of the brush bristles, and a second position in which the at distal tips are displaced from the tips of the brush bristles.

The wicking space may be occupied by a wicking material, such as a sponge, woven or non-woven fibrous material.

The displaceable mount may be detachable from the paint brush. The displaceable mount may comprise a hinge or a sliding track.

The distal tips may comprise a pair of flat plates which converge to an edge, the plates having rounded corners.

The paint brush may have bristles formed in an elongated rectangular region, the pair of flat plates being parallel to the elongated rectangular region in the first position.

The distal tips may be, in the first position, shorter than the brush bristles.

It is therefore an object to provide an edger for a paint roller, comprising: a roller frame; a roller cover, having lateral edges, the lateral edges being outside a painting width of the paint roller and being configured to glide against a surface without marring the surface; a displaceable mount, configured to have a first position in which a roller cover is fully engaged over the paint roller and a second position in which the roller cover is disengaged from the paint roller; and at least one auxiliary brush, located on at least one lateral edge of the roller cover, configured to provide painting coverage adjacent to an edge of the roller.

Another object provides a paint roller having an edger, comprising: a rod, having a pair of rollers, configured to support a paint roller concentrically about the rod; a roller cover extending beyond the paint roller in both width and length, wherein the roller cover shields the roller on top, sides, front and back; an elastic mount, configured exert a force on the rod to extend from the roller cover through the bottom, and to receive the rod into the roller cover upon application of downward pressure; and at least one auxiliary brush, located peripherally to the paint roller on the roller cover, configured to apply paint to a surface beyond a contact patch of the paint roller, guided by sliding contact of the roller cover against an adjacent surface a right angles to the contact patch.

The roller cover may be attachable to and detachable from the roller frame, or permanently attached to the roller frame.

The roller cover has four corners, and may have a respective auxiliary brush is provided in each corner, and may comprise a plastic shell.

The displaceable mount may comprise a hinge, spring, and/or a sliding track.

The at least one auxiliary brush may be removable from and attachable to the roller cover.

A tab may be provided on an exterior surface of the roller cover, configured to apply a manual tension to move the displaceable mount from the first position to the second position.

DETAILED DESCRIPTION OF THE INVENTION

Example 1

Paint Roller Attachment

Figure 1:
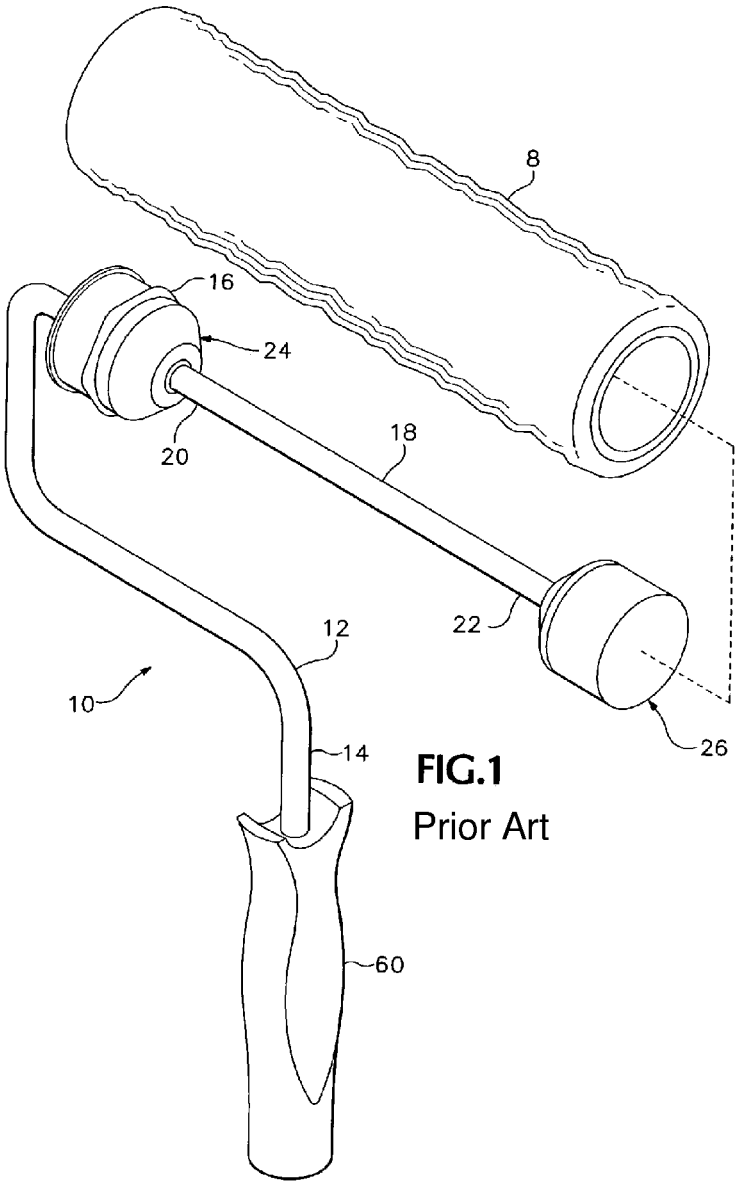
FIG.1 Prior Art
FIG. 1 shows a prior art paint roller.
Figures 2A, 2B:
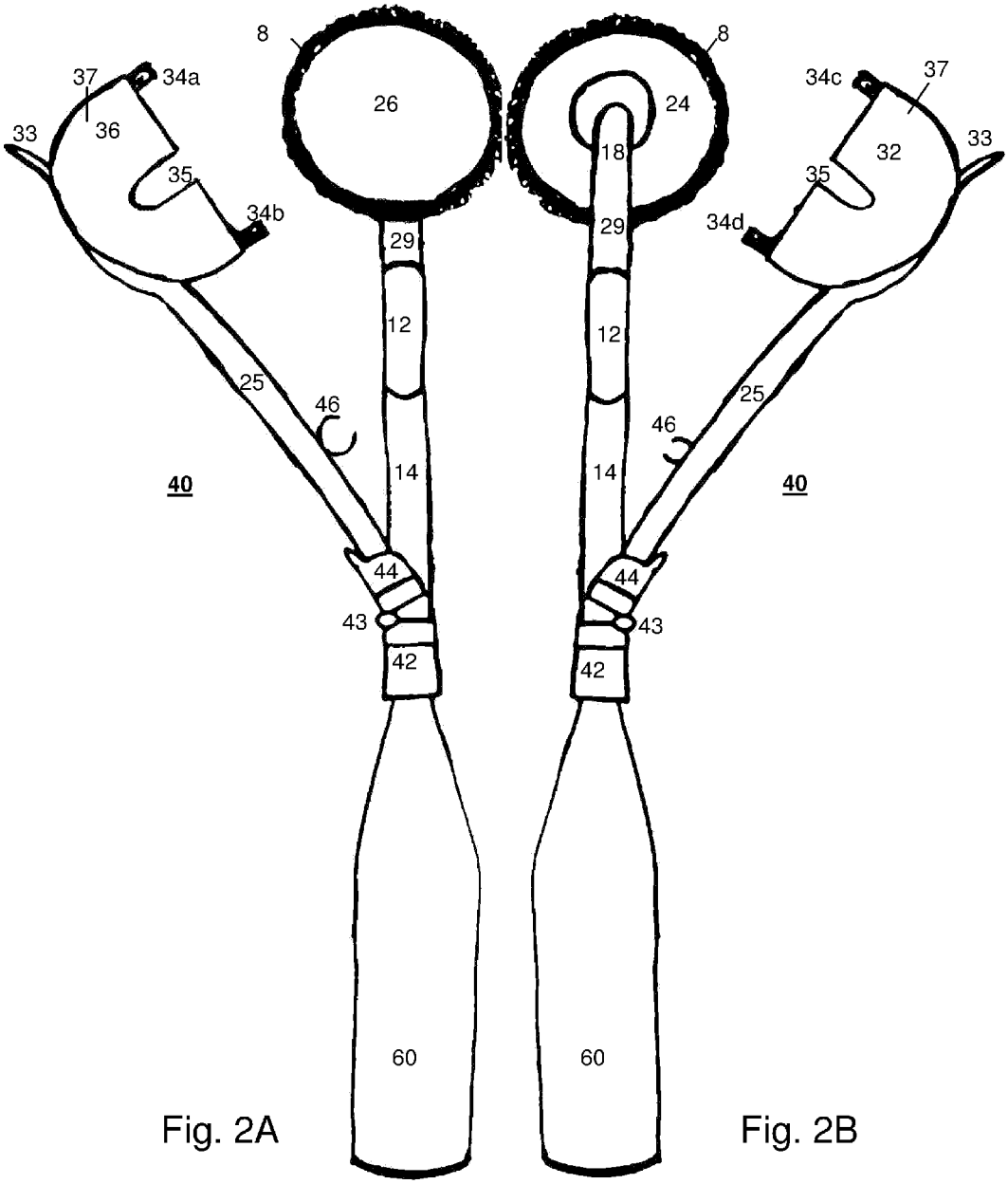
FIGS. 2A and 2B show left and right side views of an embodiment of an edger attachment, optionally having a clamp.

The present invention provides an edger/trimmer having a two-piece construction which is mountable to a variety of sized paint roller, as shown in FIGS. 2A and 2B. The edger/trimmer according to the present technology may also be manufactured already attached to a paint roller, as shown in FIGS. 3 and 4. The size of this invention can vary, depending on the size of the paint roller which it is intended for use.

The edger can be manufactured as a plastic or medal product, or other suitable materials i.e., wood, cardboard, composite, etc. The type of plastic used can be of multiple types, such as polyvinyl chloride, polyethylene, Polyethylene Terephthalate, High Density Polyethylene, Low Density Polyethylene, Polypropylene, Polystyrene, polylactic acid, nylon, rubber, acrylic, polycarbonate, epoxy, for example, or any combination thereof. The type of metal can vary as well, such as aluminum or steel, for example, or any combination thereof. This edger can also be manufactured with a combination of plastic and metal, including all types previously mentioned.

Where the edger is manufactured as an attachment 40, it will typically have be attached at a base of the handle 60 with an attachment clip 42, which attaches to the metal frame 12, 14 (directly above the handle 60) of the paint roller, and is secured new the base of the handle 60 with a screw or multiple screws. The edger has a hinge 43, which may include an elastic element, which allows it to be deployed from, and retracted into, the roller cover 37 as desired. An optional clamp 46, as shown in FIGS. 2A and 2B, can be provided to secure the edger in the deployed position by surrounding the metal frame 14. A lip 33 along the top of the edger roller cover 37 between provides a convenient location to manually displace the edger roller cover 37 between the deployed (not shown) and retracted position (shown in FIGS. 2A and 2B). This lip 33 can also serve as a stop to prevent the roller from abutting a surface along the line of the roller.

There are a variety of techniques in which the edger as an accessory can be attached to a paint roller. This accessory can be attached to a paint roller with clamps or brackets of various types.

The edger includes a paint roller cover 37, which has a semi-circular shape, having an outside shield 36 at a respective side edge, beyond the outboard cover support assembly 26, and an inside shield 32 with recess 35 through which the frame element 29, 18 enters to axially support the roller 8. The paint roller in use is shielded from view. The outside shield 36 of roller cover 37 has direct contact with the surface of the adjacent wall, and protects the adjacent wall from being painted. The outside shield 36 prevents the paint roller 8 from reaching the adjacent wall, therefore applying paint up to approximately ¼ of an inch from the adjacent wall. This outside shield 36 has rounded edges and a smooth surface, in order to avoid scratching or scratching the adjacent surface not to be painted; specific types of plastic, or smooth applications to the shield (such as Teflon, cloth or foam) are useful for this function. This outside shield 36 serves as a natural guide, directing the roller 8 along the edge or trim being painted, in a straight line. The outer shield's lower edge, which touches the wall being painted, is preferably 1/32 inch or less thick, and has rounded edges as well. The edge consist of a very smooth and slippery (low friction) surface, as to travel along a piece of trim without getting stuck on imperfections on the surface of whatever material the paint is being applied to. This smooth and slippery edge can be created with various materials, for example slippery tape, and fiberglass.

The paint roller cover holds four small paint brushes 34*a*, 34*b*, 34*c*, 34*d* on the undercarriage of the roller cover 37, positioned directly under each corner end of the outside shield 36 and inside shield 32. These four small paintbrushes 34*a*, 34*b*, 34*c*, 34*d* are removable, as to permit be able to insertion new paintbrushes when the original paintbrushes become old and worn out. The purpose of these four paintbrushes 34*a*, 34*b*, 34*c*, 34*d* is to assist in the process of creating a straight and accurate line along the edge or trim being painted. The paint roller applies paint to the wall or surface being painted (approximately ¼ inch from the edge or trim); the small paintbrushes 34*a*, 34*b*, 34*c*, 34*d* then push the paint applied by the roller closer to the edge or trim, creating a perfect line along the edge or trim being painted. The small paintbrushes 34*a*, 34*b*, 34*c*, 34*d* are able to get closer to the wall because of their positioning on the under-carriage of the paint roller cover 37.

The traditional style of a paint roller is challenged in creating a straight line near an edge because of the nature of its inherent structure (it is not structured to create perfect lines against edges or trim). The roller 8 edge can mar or mark the adjacent surface. The small paintbrushes 34*a*, 34*b*, 34*c*, 34*d* are structured to create perfect lines along edges and trim, and are able to do so only when positioned close enough to the edge or trim being painted. The painter is able to paint a perfect line to the intended surface of application, since the roller shield 37 guides the paint roller 8 along the adjacent wall in a steady and straight manner. The positioning of the paintbrushes 34*a*, 34*b*, 34*c*, 34*d* directly under the roller shield 37 allows the paint applied from the roller 8 to be perfectly pushed over to the edge or trim by the paintbrushes 34*a*, 34*b*, 34*c*, 34*d*. The brushes 34*a*, 34*b*, 34*c*, 34*d* also thin and spread paint applied at the edge of the roller 8, which can often be thicker than in the central region of the roller 8 due to compression.

The thickness of the roller shield 37 on the lateral edges is preferably 1/16 of an inch thick or less. The remaining area of the roller shield 37 is preferably ⅛ of an inch thick or less.

The paint roller cover 40 will have a hinge 43, which is adjacent to the point of attachment to the paint roller frame 12, 14, as to allow the roller cover 37 to swivel upward and away from the roller 8. When in the open position, this feature allows the painter to apply paint to the roller 8 without getting paint on the cover, shield, or four small paintbrushes 34*a*, 34*b*, 34*c*, 34*d* on the under-carriage of the roller cover 37. There is a small tab/handle 44 extended from the point of attachment, which will assist the painter in swiveling the shield to its open or closed position without getting paint on his/her hands. The hinge 43 also serves another very important purpose. When the painter is using the roller 8 on one side of a piece of trim, the roller shield 37 will be in the correct position in relation to the adjacent surface not to be painted. However, when the painter needs to paint the opposite side of the trim, the roller shield 37 will be in the incorrect position in relation to the adjacent surface not to be painted, and the roller 8 will need to be flipped onto its opposite side, completing a 180 degree turn. When the painter performs this task of rotating to the opposite side, it is necessary that the roller cover 37 be able to swivel to the opposite side of the roller 8 as well, which is also a function of the attachment clip 42 and hinge 43.

The attachment piece 42 and hinge 43 is thus structured as to be able to swivel to the opposite side of the roller 8. There are many varieties of hinges that may be used in manufacturing this shield. When the roller cover 37 is in the open position, it would be necessary for it to stay open when applying paint to the roller 8, such as in a roller pan. A lock (not shown) may be provided to hold the hinge open. The painter may also apply a pressure on the tab 33 while the painter applies the paint to the roller 8.

It is also desirable to have a manner in which the roller cover 37 can be held in a locked position when the roller cover 37 is closed. This is achievable in a variety of ways. Directly in front of the roller cover's 37 point of attachment (i.e., near the hinge 43), the roller cover stem 25 may have a notch or clamp 46 to permit secure connection to the metal frame 12, 14 of the paint roller. When the roller cover 37 is in the closed position, it remains locked, so as not to move while painting any edge. This will ensure a straight line is painted upon the intended edge or trim.

Example 2

Paint Roller with Integral Edger

Figure 3A:
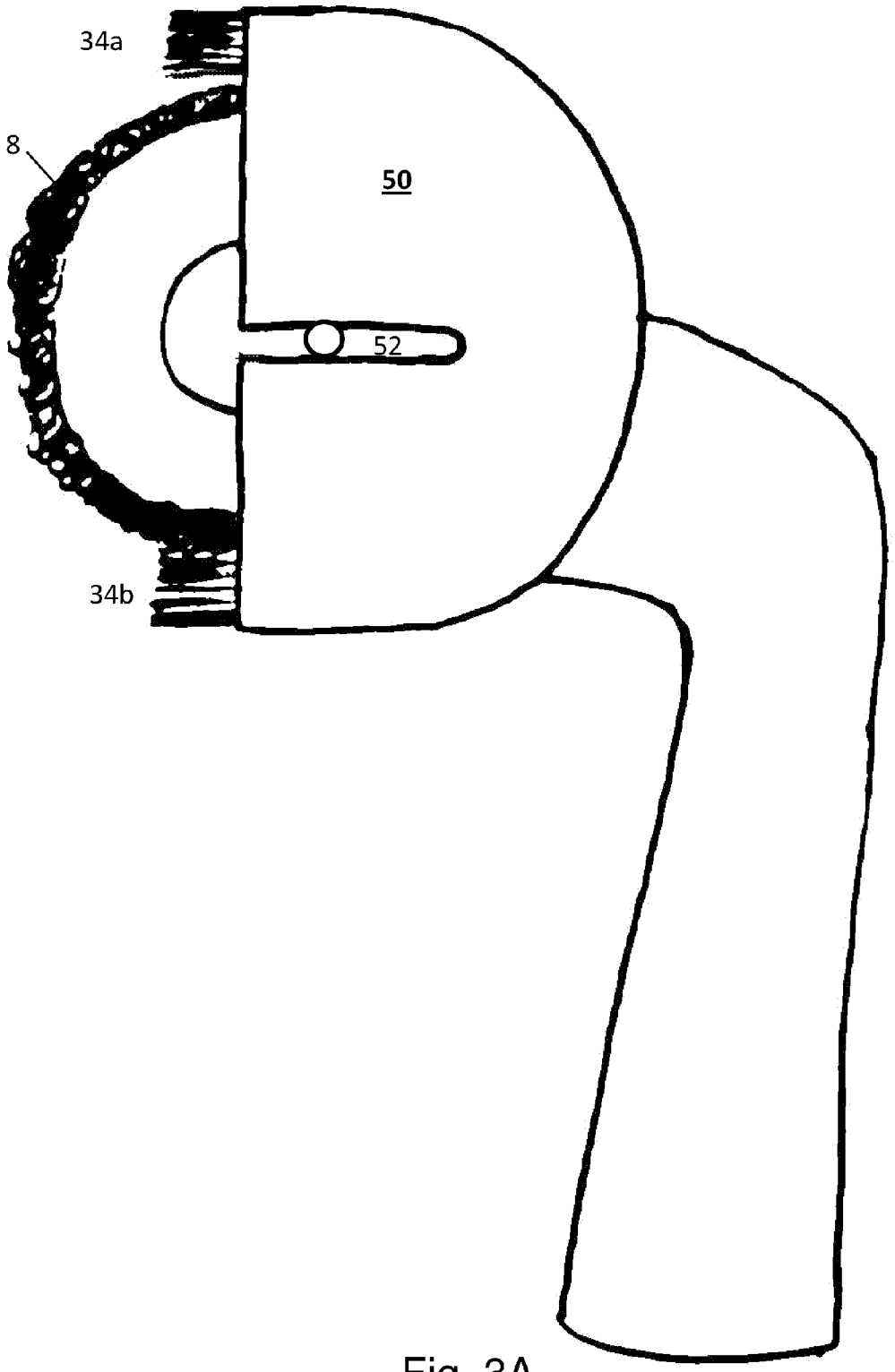
FIGS. 3A and 3B show a side and bottom view of an embodiment of a roller with integral edger.
Figure 3B:
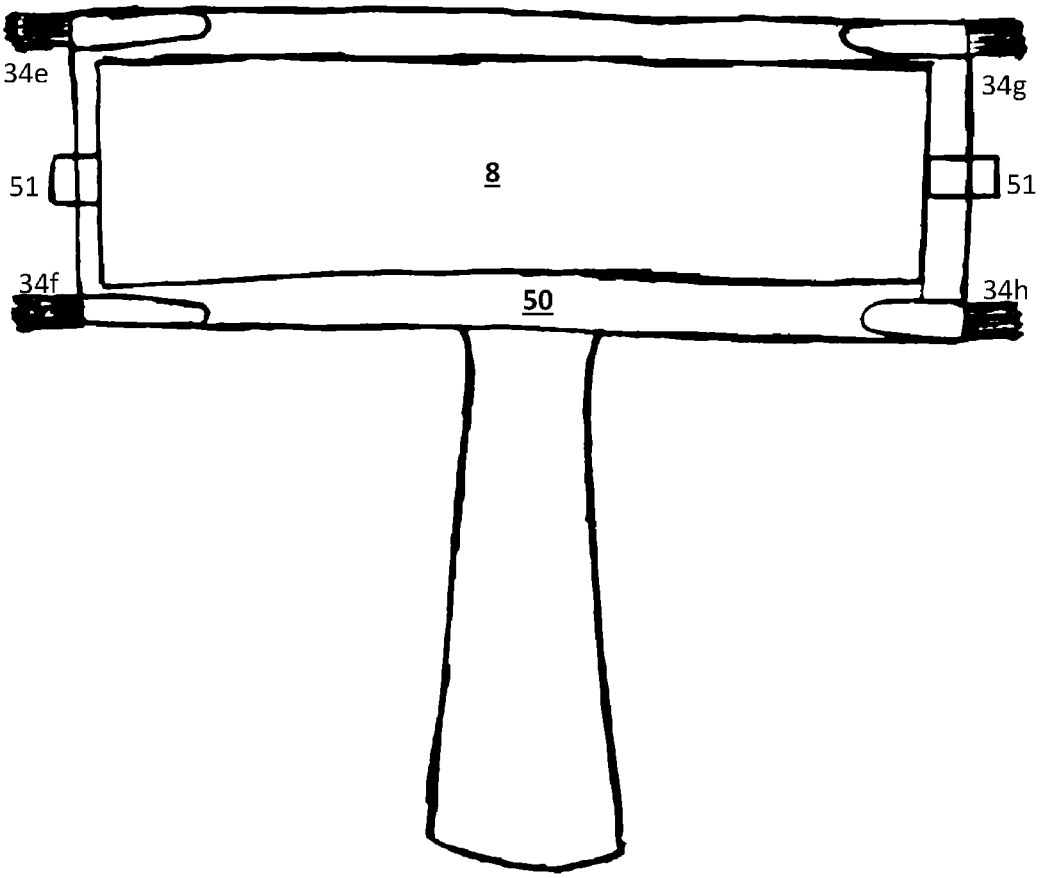

An alternate embodiment provides an integral edger for a roller 8, as shown in FIGS. 3A and 3B. In FIG. 3A, the roller 8 is shown protruding from the housing 50. The roller 8 is spring loaded (not shown), and under pressure from the painter, is recessed into the roller cover housing 50 by way of groove 52. The corner brushes 34*a*, 34*b* touch the wall when sufficient pressure is applied, and thus the painter is able to control the use of the corner brushes 34*a*, 34*b* by the amount of pressure applied. Further, the protruding roller 8 permits paint to be applied to the roller 8 without immersing the roller 50 cover in paint.

FIG. 3B shows a variation of the roller cover of FIG. 3A, in which extensions 51 from the lateral sides of the roller cover 50 may ensure that the roller cover 50 does not abut the adjacent wall. Further, the corner brushes 34*e*, 34*f*, 34*g*, 34*h* may be splayed outwards, to paint the area adjacent to the edge of the roller.

Example 3

Paintbrush with Edger Attachment

Figure 4A:
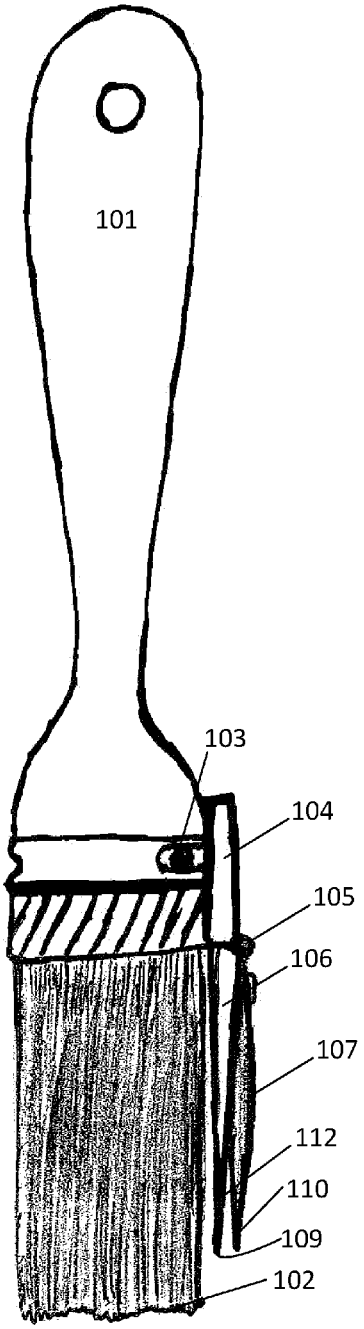
FIGS. 4A, 4B, and 4C show front views of a brush having an edger attachment, in a deployed and retracted state, and a side view of the brush having an edger attachment.
Figure 4B:
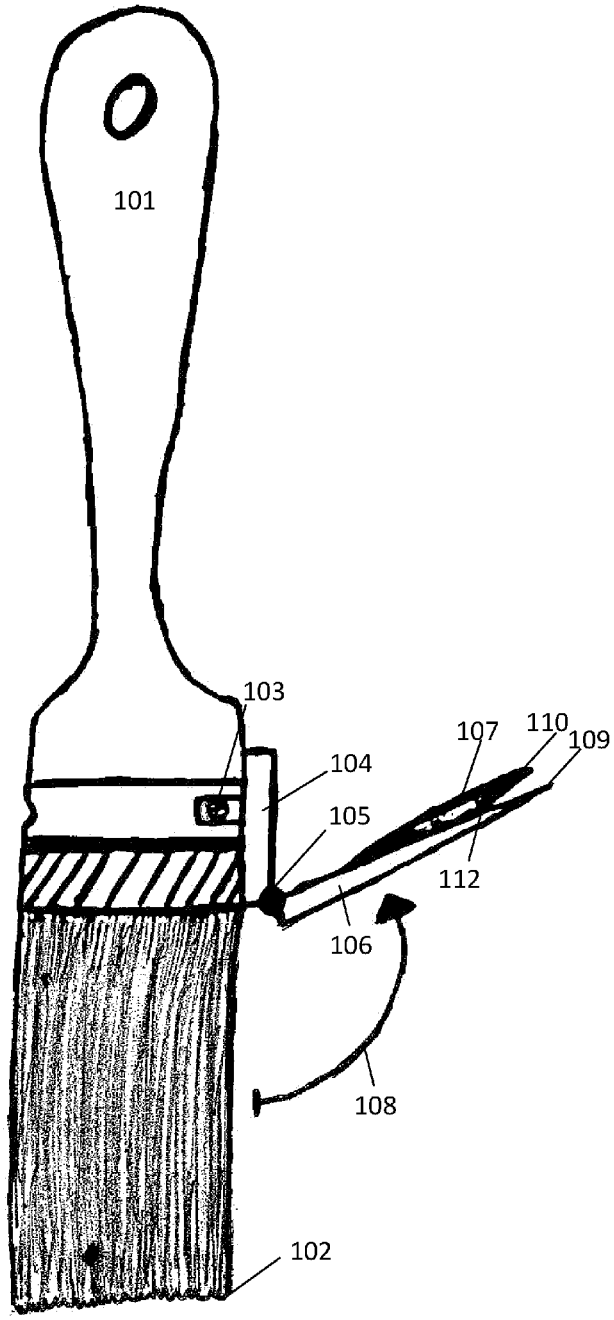
Figure 4C:
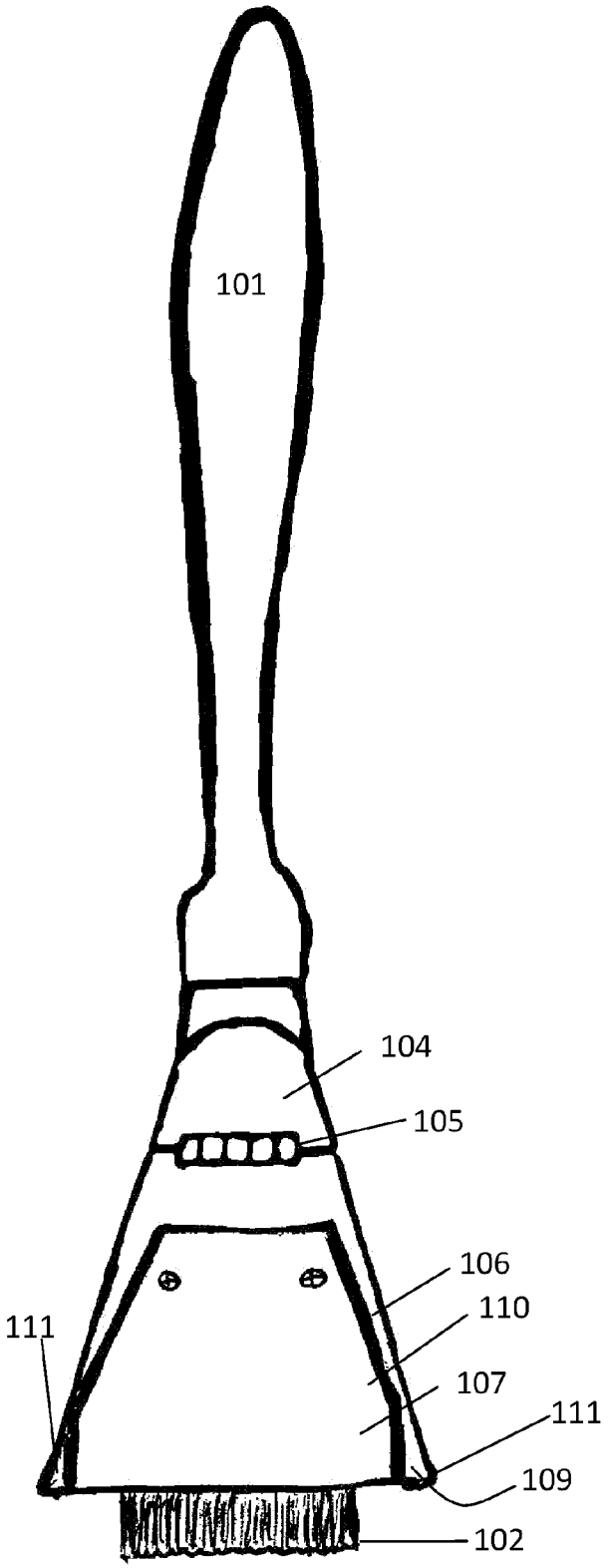

FIGS. 4A, 4B and 4C show a paintbrush embodiment, of an edger, wherein a brush 101 has a hinged attachment on a side. In the deployed position, the edger sits at right angles to the main brush, with a lateral shield to protect the wall surface adjacent to the surface being painted from getting marred by paint from the side of the brush. FIG. 4B shows the edger partially disengaged and extending away from the brush tip 102 at an angle 108. In the fully disengaged state, the lateral shield is vertical (away from brush tip 102), and may be held in either the deployed or disengaged state by a magnetic latch 104. The external side of the lateral shield may be coated with Teflon or other non-stick surface, to help avoid paint sticking.

The size of the edger can be varied in dependence on the size of the brush tip 102, or in some cases, the particular application. The edger may be formed of plastic (polyvinyl chloride, polyethylene, polypropylene, polyethylene terephthalate, etc.), metal (steel, aluminum, etc.), wood, cellulose fiber/cardboard, or other suitable materials.

The edger can be provided as an attachment for a brush 101 of standard type, or as an integral device. In the case of an attachment, a preferred embodiment has an attachment clip 103, which is attached to the paintbrush 101 and secured with a screw or multiple screws as may be necessary. The accessory edger can also be mounted onto the side of the paintbrush without a clip 103 and simply attached directly with a one or two screws, nails, adhesive (e.g., glue, double-sided tape, etc.), or the like. A mounting bracket may also be used.

A planar shield 106, having a first edge 110 is provided, which has direct contact with the brush tip 102, and provides a barrier between the brush tip 102 and the surface of the wall, edge or trim which is being painted. The edger has a second shield, having a second edge 109 as well, which blocks any paint from traveling or seeping around the first edge 110, and ensures that no paint reaches the adjacent surface to be protected. This pair of planar shields 106, 107 prevents any paint from reaching the adjacent surface not intended for painting.

Essentially, there are two planar shields 107, 106 with two edges 109, 110, which can be manufactured as one piece, or as a laminated structure. In some cases, the planar shields 106, 107 are detachable and replaceable. For example, if the shields become soiled or contaminated, the unit may be replaced with a clean one.

In the area between the two planar shields 106, 107 there is a hollow space, in essence a reservoir. If paint is able to travel around the first edge 106, the paint will be blocked by the second edge 107 and travel up into the reservoir by capillary action, therefore reducing the tendency for the paint to leak to the adjacent wall. Indeed, the reservoir may have a sponge or wick 112 which actively draws paint into the space as it wets. Such a sponge or wick 112 would generally be disposable.

In the area between the two planar shields 106, 107 there is a hollow space, in essence a reservoir. If paint is able to travel around the first edge 109, the paint will be blocked by the second edge 110 and travel up into the reservoir by capillary action, therefore reducing the tendency for the paint to leak to the adjacent wall. Indeed, the reservoir may have a sponge or wick 112 which actively draws paint into the space as it wets. Such a sponge or wick 112 would generally be disposable.

The first and second edges of the shield are very thin (1/32 of an inch thick or less) at the point in which they are touching the surface being painted. The top of the shield (where the shield is attached to the paint brush) has a thickness of no greater than 1/8 of an inch. The thickness of the shield becomes progressively thinner toward its distal edge. This creates a sloping effect, which has an important function in the edging process. As noted earlier, there are times in which small amounts of paint may travel around the first edge of the shield; the angle the shield creates wicking force due to the surface tension of the paint, which assists the unwanted paint in traveling up the shield and away from the second edge. This system creates a an extra safety net in terms of keeping the excess and unwanted paint from reaching the adjacent surface, which is not intended to be painted.

The distal edge of the planar shield, away from the handle, serves as a natural guide when inserted into the intended edge at a 45 degree angle; and insures a straight line will be applied to the trim or edge of intended applied surface, as the painter moves the brush either up or down the intended line. That is, the brush is used to paint trim, and the edger is particularly useful in corners. When the painter inserts the brush with edger into the corner, it is preferred that the brush sit at a 45 degree angle to the corner, wherein one side is intended to be painted, and the other side is intended to be shielded.

The planar edges consist of a very smooth and slippery surface, as to travel along an edge without getting stuck on imperfections on the surface of whatever material the paint is being applied to. This smooth and slippery edge can be created with various products, such as a slippery tape, Teflon or fiberglass.

The shape of the planar shield may be, for example, square or triangular in shape.

The corners of the first and second edges at the bottom of the shield are preferably rounded, as to ensure a smooth path along any surface traveled. Thus, the edges serve as a guide for the brush in the corner, and the leading portion of the edger preferably does not have a sharp extension that might dig into the wall or otherwise become lodged.

Figure 5A:
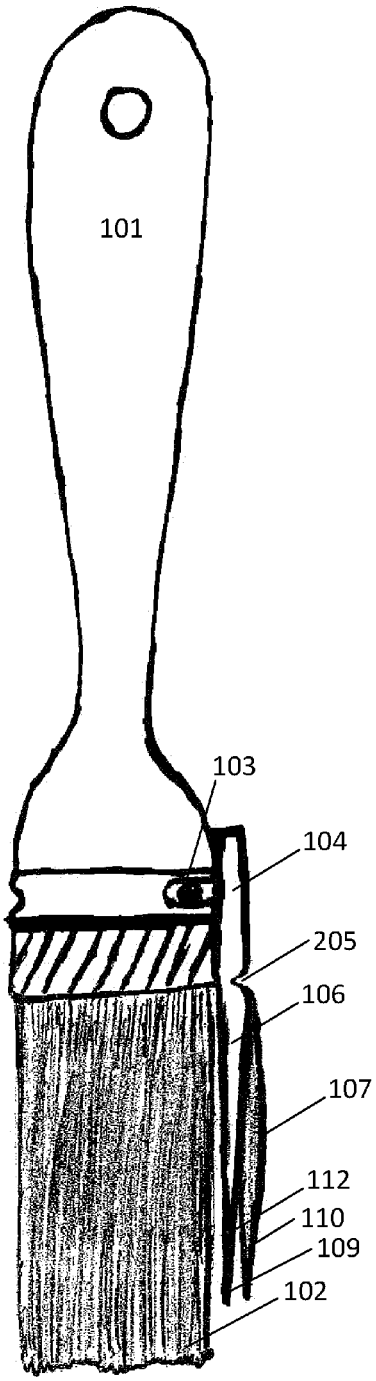
FIGS. 5A, 5B, and 5C show front views of a brush having a second embodiment of an edger attachment, in a deployed and retracted state, and a side view of the brush having an edger attachment.
Figure 5B:
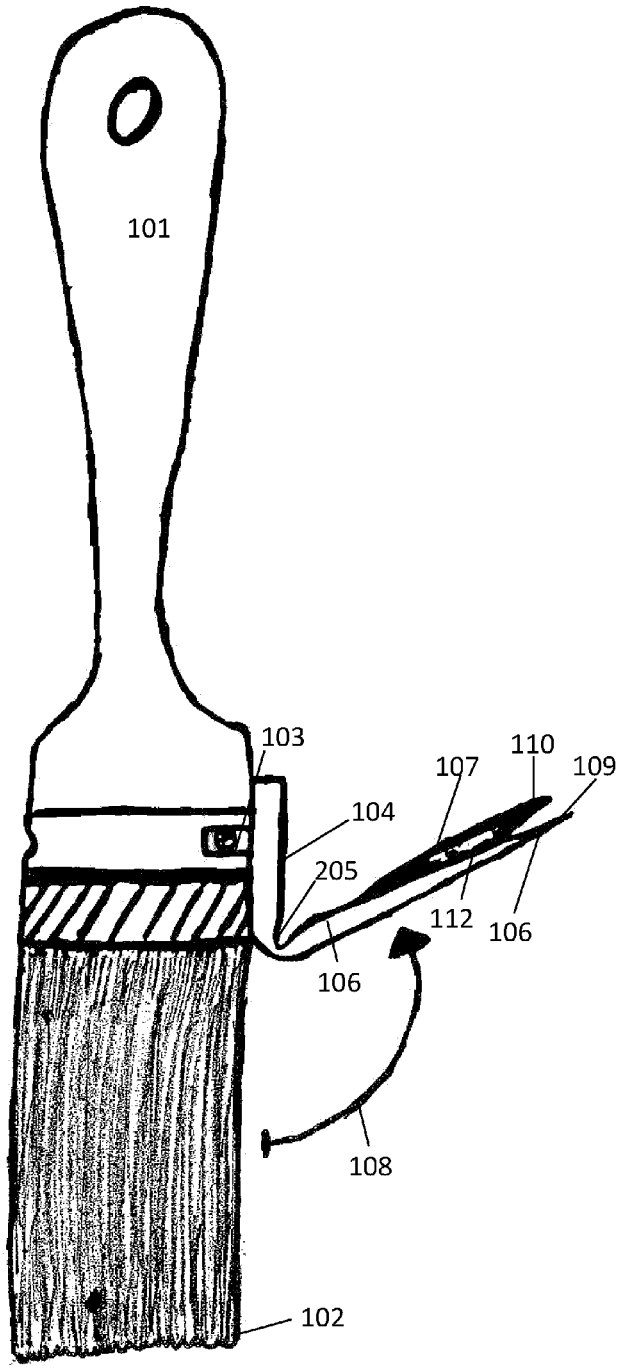
Figure 5C:
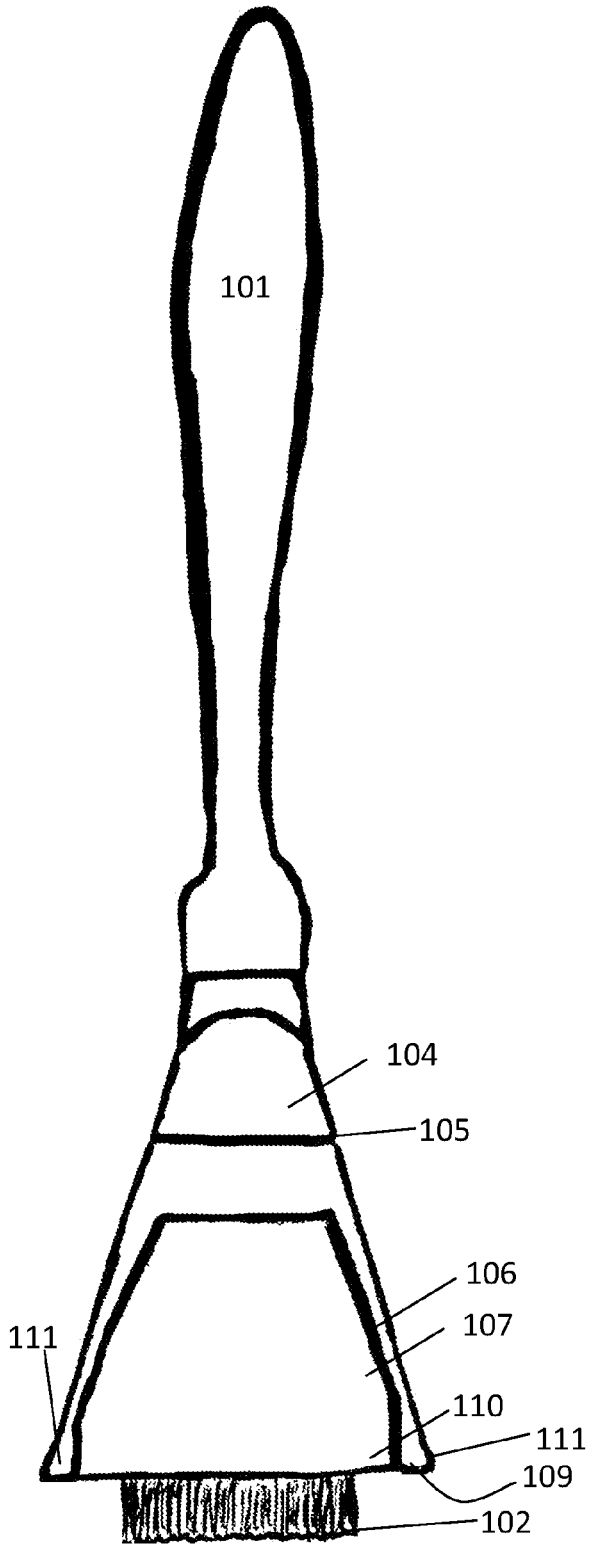

The planar shield according to the first embodiment shown in FIGS. 4A, 4B and 4C has a hinge 105 between the lower and the upper portion of the assembly, as to allow the bottom half including shields 106, 107 to swivel upward and away from the bristles of the brush tip 102 of the paintbrush 101. This feature allows the painter to apply paint to the bristles of the brush tip 102 of the brush 101 without getting paint on the planar shields 106, 107, and also to paint areas that do not require edging. A small tab/handle 111 is provided on each side of the planar shields 106, 107, which assists the painter in swiveling the shield to its open or closed position, without getting paint on his/her hands. For example, a piano hinge may be used as the hinge 105 for a metal edger attachment. According to a second embodiment of the edger shown in FIGS. 5A, 5B and 5C, hinge 205 may is formed of a locally thinned line of plastic, which can be formed by molding or in a post-process. Thus, an integral plastic hinge 205 may be formed together with one or both shields 106, 107. For example, a groove may be formed at the hinging line about ¾ of the way through the plastic shield, which creates a natural hinge. A latch or hitch (not shown) may be provided on the bottom portion of the edger, which permits it to be locked in position when open (for applying paint to the brush) or closed (for edging). This will insure a straight line is painted upon intended edge or trim.

Another type of system may also be used for opening and closing the shield. This system involves a track in which the shield may slide up or down the paintbrush. This track system involves no hinges and allows the painter to slide the shield up the paintbrush, as to not get paint on the shield while applying paint to the bristles, with a locking mechanism to keep the shield in an open position. The shield would then be able to slide down the paintbrush to a closed position, with a locking mechanism to keep the shield in a closed position.

Therefore, a paint brush accessory mountable on a paint brush handle includes a planar shield having a first edge and an opposed second edge. The first edge is used as a sliding guide upon the intended surface to be guided in a straight line when inserted to said trim or edge at an angle. The first edge is very thin at the point of contact with the wall or said surface, and is preferably rounded at each end of the shield. The first edge blocks paint from reaching the adjacent wall to be protected. A second edge is provided between the brush bristles and the first edge, providing a double barrier and a space in between which acts by capillary action to remove paint from the distal edge of the edger attachment. This hollow space may cover the entire bottom half of the shield. The first and second edge are either formed of a low frictional coefficient material, or have a suitable lubricating coating, in order to provide a smooth ride over the intended surface. The shield may be displaced while applying paint to the bristles of the brush, and close while applying paint to the edge on the wall or trim.

Thus there has been shown various embodiments of the invention. The invention may encompass combinations and subcombinations of the features herein disclosed and described. The scope of the invention is limited solely by the scope of the claims hereinafter provided.

What is claimed is:

1. An edger for a paint brush having brush bristles, comprising:

at least two adjacent shields, separated by a wicking space, having distal tips configured to glide in a corner, and a surface of one of the at least two adjacent shields configured to glide against a wall, to protect one wall of the corner from contact with the brush bristles by providing a mechanical barrier, and to withdraw paint which seeps into the corner into the wicking space between the at least two adjacent shields, wherein the at least two adjacent shields comprise a pair of flat plates which diverge toward the distal tips with the wicking space disposed therebetween; and a displaceable mount, configured for attachment to the paint brush, comprising a hinge formed integrally with at least one of the at least two adjacent shields and to have:

a first position in which the distal tip of one of the at least two adjacent shields is adjacent to tips of the brush bristles, and a second position in which the distal tips of the at least two adjacent shields are displaced away from the tips of the brush bristles.

2. The edger according to claim 1, wherein the wicking space is occupied by a wicking material.

3. The edger according to claim 1, wherein the displaceable mount is detachable from the paint brush.

4. The edger according to claim 1, wherein the hinge comprises a thinned line of plastic.

5. The edger according to claim 4, wherein the brush bristles are formed in an elongated rectangular region, and the pair of flat plates are generally parallel to the elongated rectangular region in the first position.

6. The edger according to claim 1, wherein the displaceable mount comprises a clip configured to permit detachment and replacement of the at least two adjacent shields.

7. The edger according to claim 1, wherein the displaceable mount comprises a magnetic latch configured to maintain the distal tips in the second position.

8. The edger according to claim 1, wherein the distal tips are, in the first position, shorter than the brush bristles, such that the tips of the brush bristles extend beyond the distal tips.

9. A method of painting a first surface of a wall which ends in a concave corner with a second surface of another wall, while protecting the second surface of the other wall from paint application, comprising:

providing an edger for a paint brush having brush bristles, comprising at least two adjacent shields, separated by a wicking space, having distal tips configured to glide in a corner, and a surface of one the at least two adjacent shields configured to glide against a wall, to protect one wall of the corner from contact with the brush bristles by providing a mechanical barrier, and to withdraw paint which seeps into the corner into the wicking space between the at least two adjacent shields, wherein the at least two adjacent shields comprise a pair of flat plates which diverge toward the distal tips with the wicking space disposed therebetween; and a displaceable mount configured for attachment to the paint brush, comprising a hinge formed integrally with at least one of the at least two adjacent shields, and to have a first position in which the distal tip of one of the at least two adjacent shields is adjacent to tips of the brush bristles, and a second position in which the distal tips of the at least two adjacent shields are displaced away from the tips of the brush bristles;

displacing the displaceable mount to the second position;

immersing the tips of the brush bristles into liquid paint;

displacing the displaceable mount to the first position;

positioning the edger at the concave corner, with the at least two adjacent shields toward the second surface of the other wall, such that the distal tips of the at least two adjacent shields are inserted into the concave corner and the brush bristles are separated from the second surface of the other wall by the at least two adjacent shields;

moving the edger with respect to the first surface of the wall such that liquid paint on the tips of the brush bristles is transferred to the first surface of the wall; and wicking paint from the corner into the wicking space.

10. The method according to claim 9, wherein the wicking space is occupied by a wicking material.

11. The method according to claim 9, wherein the displaceable mount is detachable from the paint brush.

12. The method according to claim 9, wherein the hinge comprises a thinned line of plastic.

13. The method according to claim 12, wherein the brush bristles are formed in an elongated rectangular region, and the pair of flat plates are generally parallel to the elongated rectangular region in the first position.

14. The method according to claim 9, wherein the displaceable mount comprises a molded plastic hinge.

15. The method according to claim 9, wherein the displaceable mount comprises a magnetic latch configured to maintain the distal tips in the second position.

16. The method according to claim 9, wherein the distal tips are, in the first position, shorter than the brush bristles, such that the tips of the brush bristles extend beyond the distal tips.

17. An edger for a paint brush having brush bristles, comprising:

a shield having a distal tip configured to glide in a corner formed between two walls, while the brush bristles contact a surface of a first wall of the corner, to provide a mechanical barrier against contact of the brush bristles against a surface of a second wall of the corner, the distal tip being spaced from a further plate-like element having a surface configured to slide against the surface of the second wall, the plate-like element being divergent with the shield toward the distal tip, and configured to form a wicking space between the shield and the plate-like element which is configured to draw liquid paint from the distal tip, between the shield and the further plate-like element by capillary action, and to isolate the wicking space at least near the distal tip from the brush bristles; and a displaceable mount, configured for attachment to the paint brush, comprising a hinge formed integrally with at least one of the shield and the further plate-like element, and to have:

a first position in which the distal tip is adjacent to the brush bristles, sufficiently close to permit the brush bristles to apply paint to the surface of the first wall up to the corner, and a second position in which the distal tip is displaced away from the brush bristles, sufficient to permit dipping of the brush bristles into a liquid paint without contact of the liquid paint with the distal tip.

18. The edger according to claim 17, wherein the wicking space is occupied by a wicking material.

19. The edger according to claim 17, wherein the displaceable mount is selectively detachable from and reattachable to the paint brush.

20. The edger according to claim 17, wherein the shield and the plate-like element each comprise a flat plate, which mutually diverge toward the distal tip, each of the flat plates having rounded corners, and the hinge comprises a molded plastic groove.

* * * * *